US007246760B2

(12) United States Patent
Marty et al.

(10) Patent No.: US 7,246,760 B2
(45) Date of Patent: Jul. 24, 2007

(54) SWIVEL MOUNT FOR A SPRAY HEAD

(75) Inventors: Garry Marty, Fishers, IN (US); Gerald McNerney, Carmel, IN (US); Russell D. Hester, Odenton, MD (US); Keith Berning, Jessup, MD (US)

(73) Assignee: Masco Corporation of Indiana, Indianapolis, IN (US)

( * ) Notice: Subject to any disclaimer, the term of this patent is extended or adjusted under 35 U.S.C. 154(b) by 557 days.

(21) Appl. No.: 10/784,022

(22) Filed: Feb. 20, 2004

(65) Prior Publication Data

US 2005/0184173 A1 Aug. 25, 2005

(51) Int. Cl.
*B05B 15/08* (2006.01)

(52) U.S. Cl. ..... 239/587.4; 239/552; 239/587.1; 239/590; 239/600; 4/541.6; 285/261

(58) Field of Classification Search ..... 239/553, 239/553.5, 548, 552, 587.1, 587.4, 600, 587.5, 239/DIG. 4, 590, 590.5; 4/541.1, 541.3, 4/541.5, 541.6; 285/46, 261, 271, 272, 331
See application file for complete search history.

(56) References Cited

U.S. PATENT DOCUMENTS

| | | | | |
|---|---|---|---|---|
| 3,582,114 | A | 6/1971 | Andersen | |
| 4,298,219 | A | 11/1981 | Amelink | |
| 5,205,490 | A | 4/1993 | Steinhardt et al. | |
| 5,265,286 | A * | 11/1993 | Filipponi | 4/541.6 |
| 5,299,743 | A | 4/1994 | Sieth et al. | |
| 6,264,122 | B1 * | 7/2001 | Perdreau et al. | 239/600 |
| 6,322,004 | B1 | 11/2001 | Perdreau et al. | |
| 6,491,238 | B1 * | 12/2002 | Swanson et al. | 239/587.4 |
| 6,536,809 | B2 | 3/2003 | Marty et al. | |
| 6,547,966 | B2 | 4/2003 | Allmendinger et al. | |
| 6,889,916 | B2 * | 5/2005 | Loyd et al. | 239/587.1 |

* cited by examiner

*Primary Examiner*—Steven J. Ganey
(74) *Attorney, Agent, or Firm*—Baker & Daniels LLP

(57) ABSTRACT

A swivel mount for a spray head configured to be at least partially recessed within a mounting surface of a wall.

24 Claims, 14 Drawing Sheets

SWIVEL MOUNT FOR A SPRAY HEAD

BACKGROUND AND SUMMARY OF THE INVENTION

The present invention relates to a mounting assembly for supporting a spray head in a wall of a tub or shower installation.

Conventional body spray assemblies typically use a simple rotatable ball spray head to provide the swivel required for directing fluid flow. Such conventional ball spray heads have necessitated that the entire body spray assembly be positioned on the visible side of the tub or shower installation.

The present invention provides a swivel mount permitting at least a portion of the spray head assembly to be hidden behind the wall of the tub or shower installation. This provides not only a more pleasing installed appearance with less spray head assembly exposed within the tub or shower, but also permits the use of spray heads having increased axial lengths. For example, technically advanced spray heads often include complex arrangements of fluid chips and, as such, have a length greater than conventional ball spray heads. The swivel mount of the present invention permits recessed mounting, thereby facilitating the use of such elongated spray heads without causing undesired intrusion into the tub or shower installation.

The swivel mount of the present invention includes a body coupled to the spray head and having an outer surface with a semi-spherical portion. A holder supports the body, and a seal is positioned intermediate the semi-spherical portion of the body and the holder. First and second retainers cooperate to compress the seal between the body and the holder with sufficient force to provide sealing engagement therebetween while permitting rotating and pivoting movement of the body relative to the holder.

Additional features and advantages of the present invention will become apparent to those skilled in the art upon consideration of the following detailed description of the presently perceived best mode of carrying out the invention.

BRIEF DESCRIPTION OF THE DRAWINGS

The detailed description of the drawings particularly refers to the accompanying figures in which.

DETAILED DESCRIPTION OF THE DRAWINGS

Figure 6:
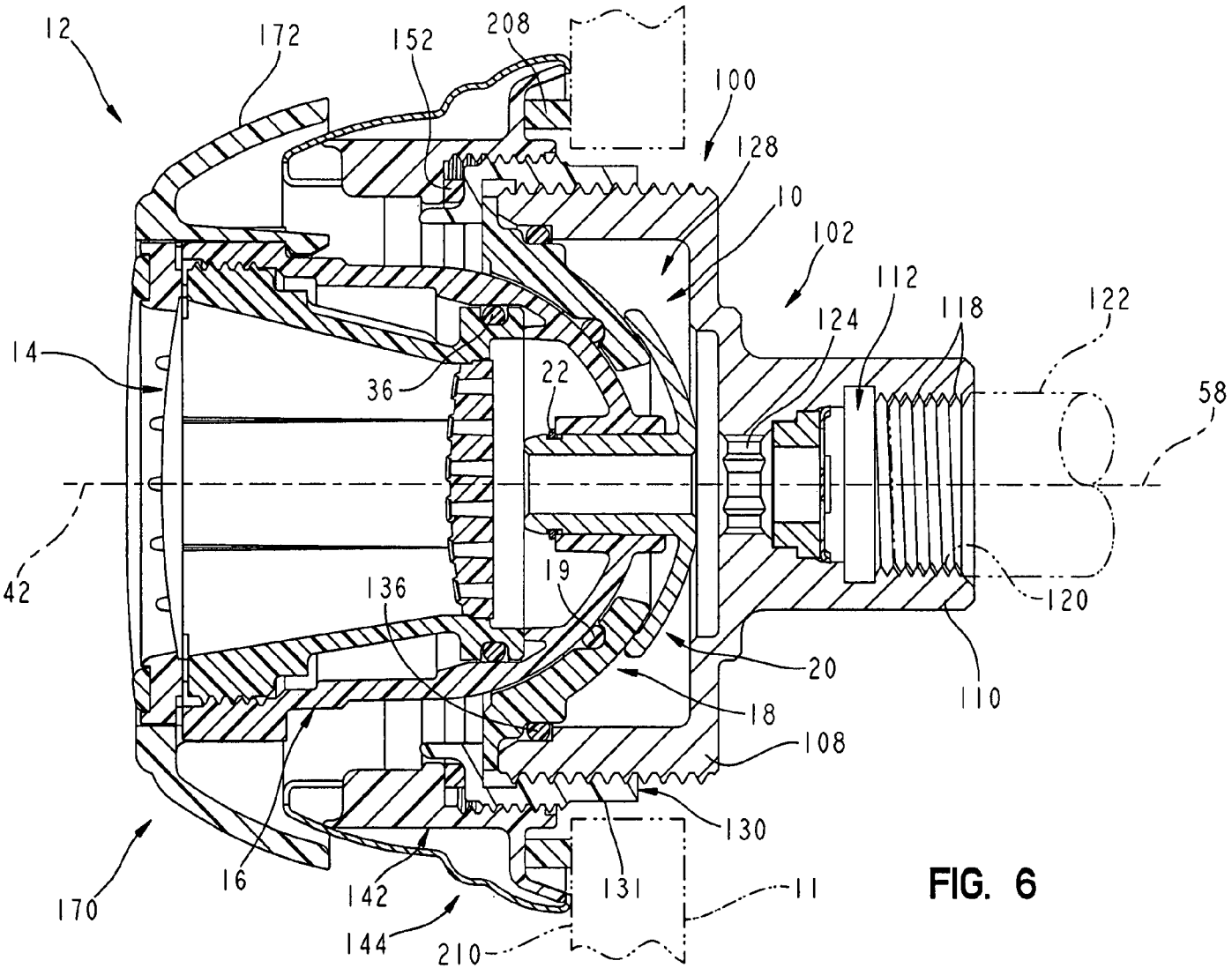
FIG. 6 is a cross-sectional view similar to FIG. 3, with the details of the fluid chips of the spray head removed for clarity and showing the spray head assembly mounted in a recessed position relative to a wall of a tub or shower installation.

In accordance with the present invention as illustrated in FIGS. 1-3 and 6, a swivel mount assembly 10 is employed within a spray head assembly 12. The spray head assembly 12 may generally be mounted on a wall 11 of a tub or a shower (FIG. 6). It should be appreciated that a wide variety of spray heads 14, including spouts, body sprays, shower heads, or other like devices may be coupled to the swivel mount assembly 10 of the present invention depending upon the particular application.

Figure 1:
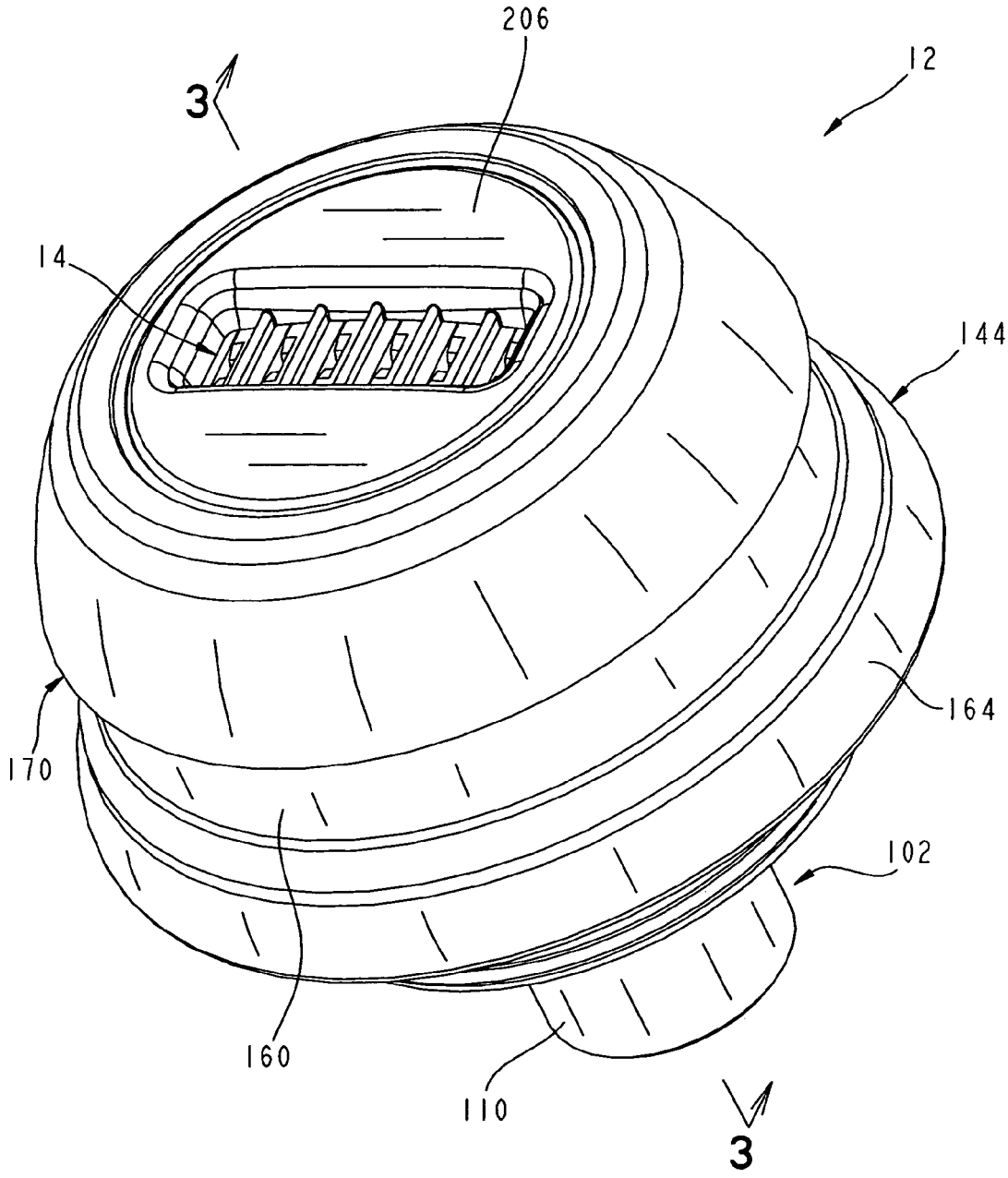
FIG. 1 is a perspective view of the spray head assembly of the present invention.
Figure 2:
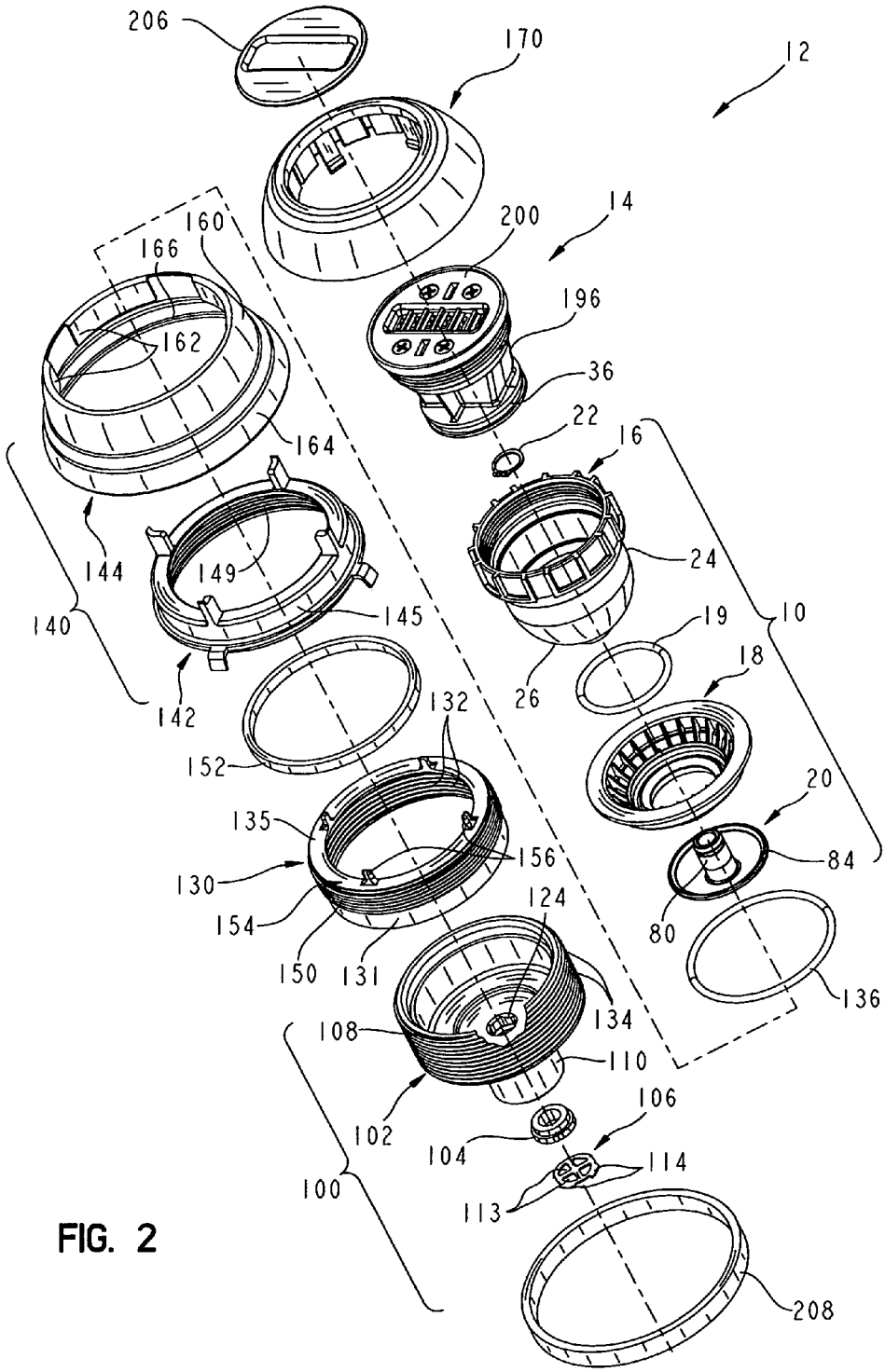
FIG. 2 is an exploded perspective view of the spray head assembly of the present invention.
Figure 3:
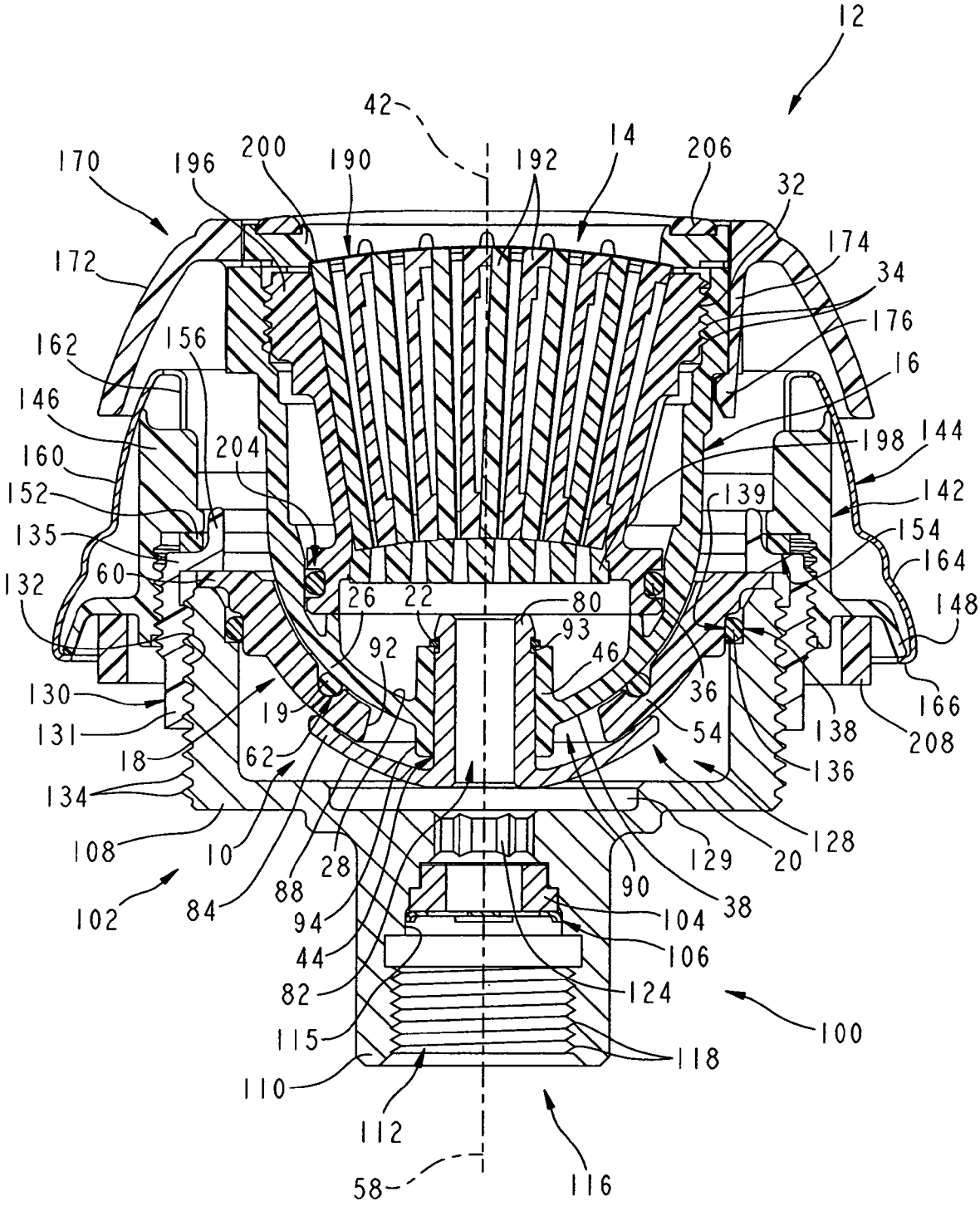
FIG. 3 is a cross-sectional view taken along line 3-3 of FIG. 1, illustrating the spray head in a center position coaxially aligned with the longitudinal axis of the holder.
Figure 7:
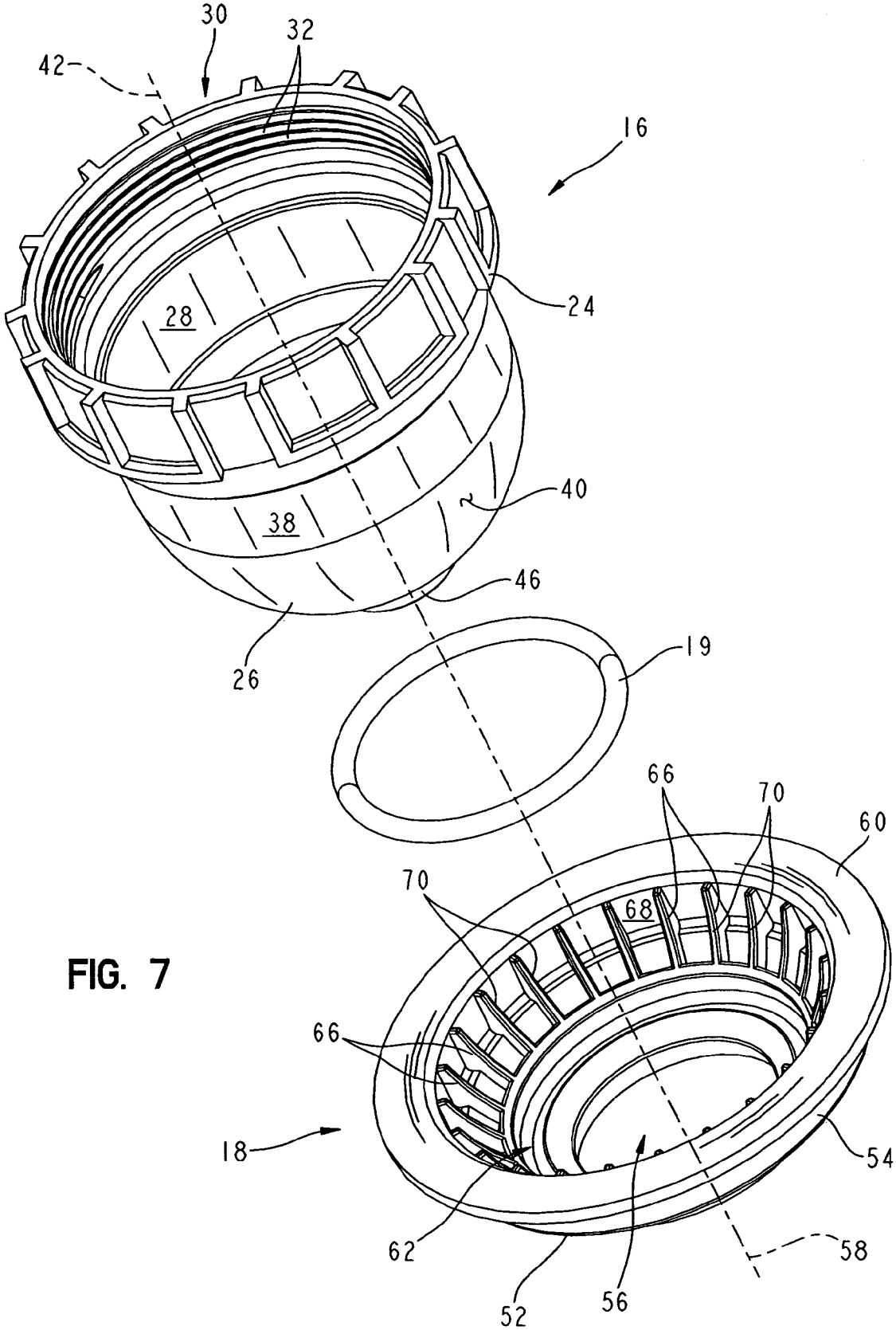
FIG. 7 is a detailed exploded perspective view of the body, the annular seal, and the holder of the swivel mount of the present invention.
Figure 8:
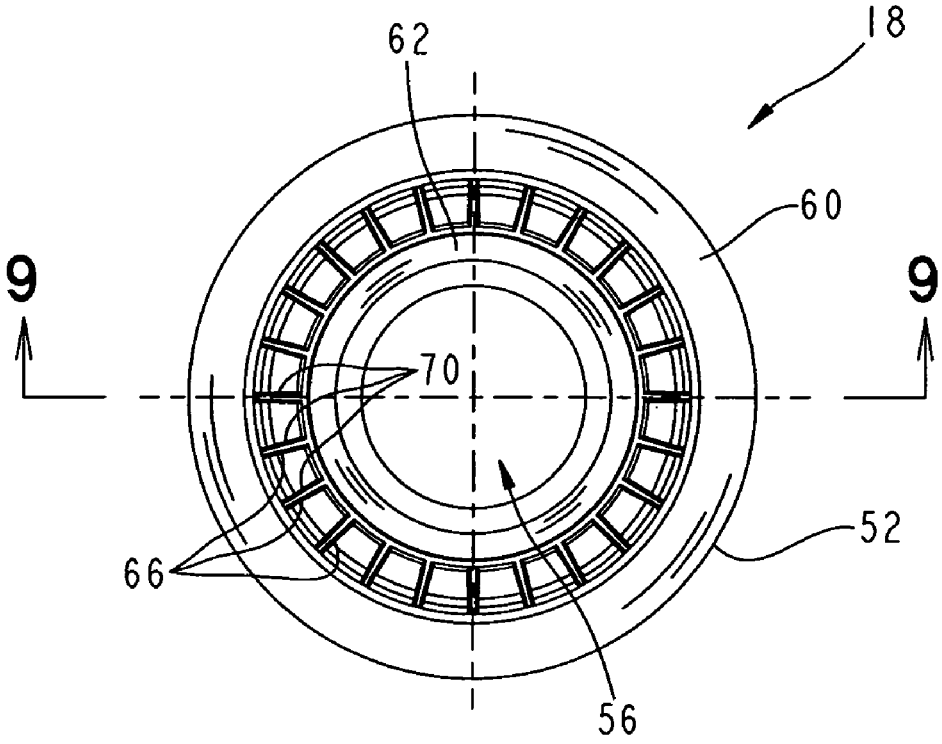
FIG. 8 is a top plan view of the holder.
Figure 9:
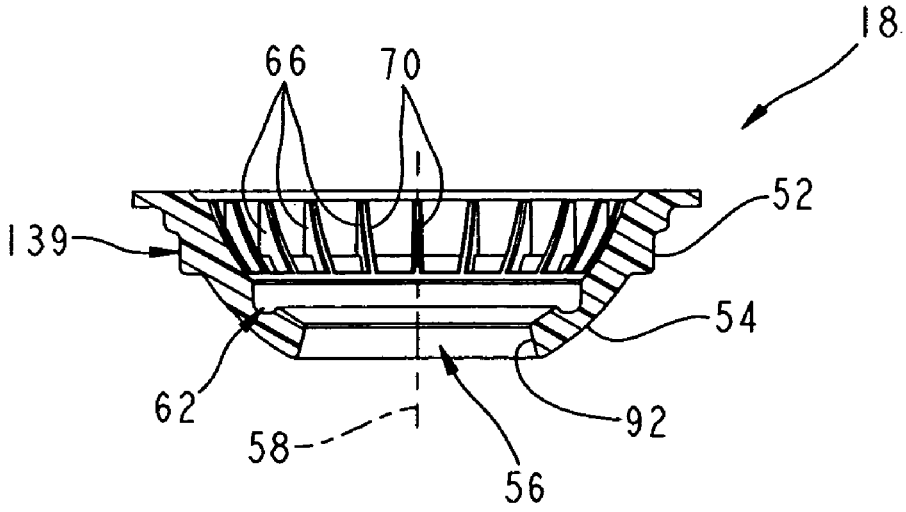
FIG. 9 is a cross-sectional view of the holder taken along line 9-9 of FIG. 8.
Figure 17:
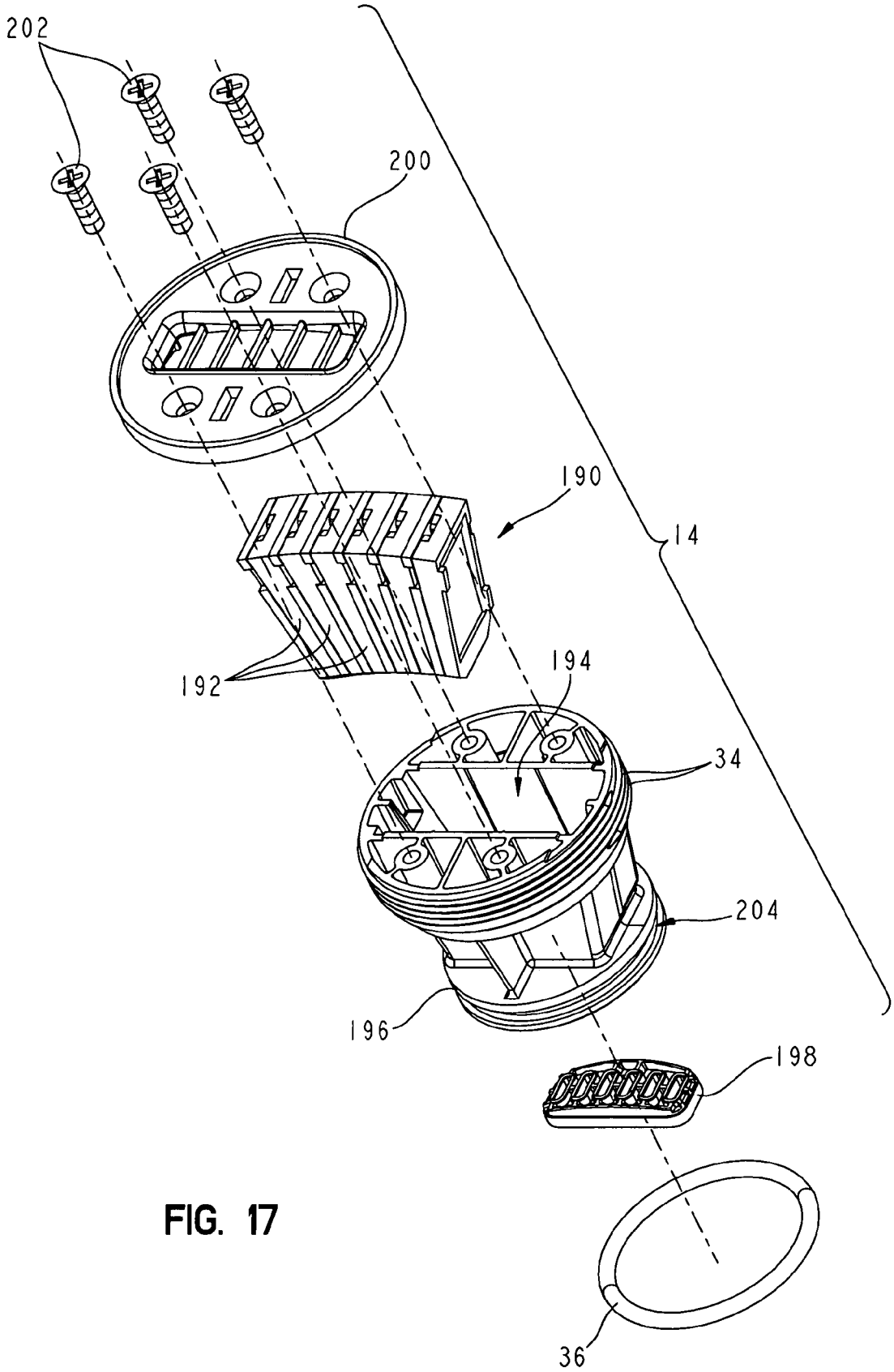
FIG. 17 is an exploded perspective view of an illustrative embodiment fluidic cartridge assembly.

Referring now primarily to FIGS. 2, 3, and 7, the swivel mount assembly 10 includes a pivot body 16, a holder 18, an annular seal 19, a first retainer 20 and a second retainer 22. The pivot body 16 includes a substantially cylindrical upper portion 24 and a semi-spherical lower portion 26. The inner surface 28 of the pivot body 16 is configured to receive the spray head 14 through an upper opening 30. The inner surface 28 of the upper portion 24 illustratively includes a plurality of female threads 32 which threadably engage a plurality of male threads 34 formed within the spray head 14 (FIGS. 3 and 17). As described in greater detail below, an annular seal 36 is positioned intermediate the spray head 14 and the pivot body 16 in order to provide sealing engagement therebetween.

Figure 11:
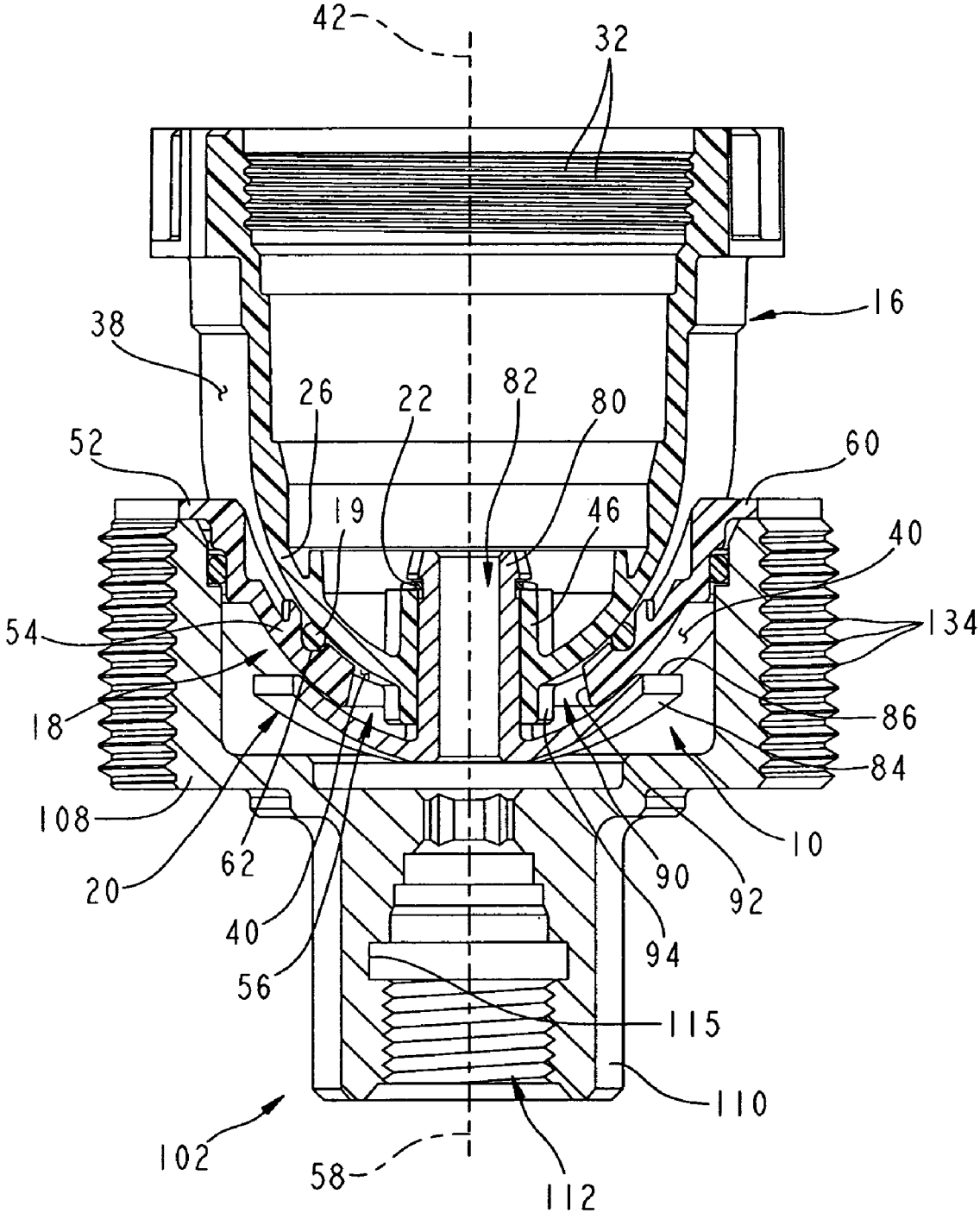
FIG. 11 is a side elevational view of the swivel mount of the present invention received within the nipple, but with a wedge-shaped portion thereof removed for illustrative purposes.
Figure 12:
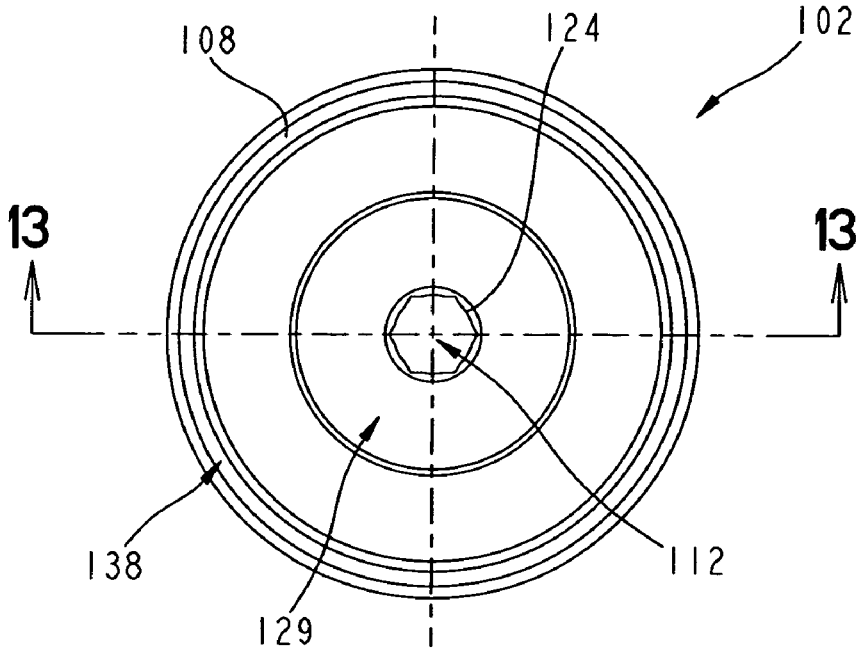
FIG. 12 is a top plan view of the nipple.
Figure 13:
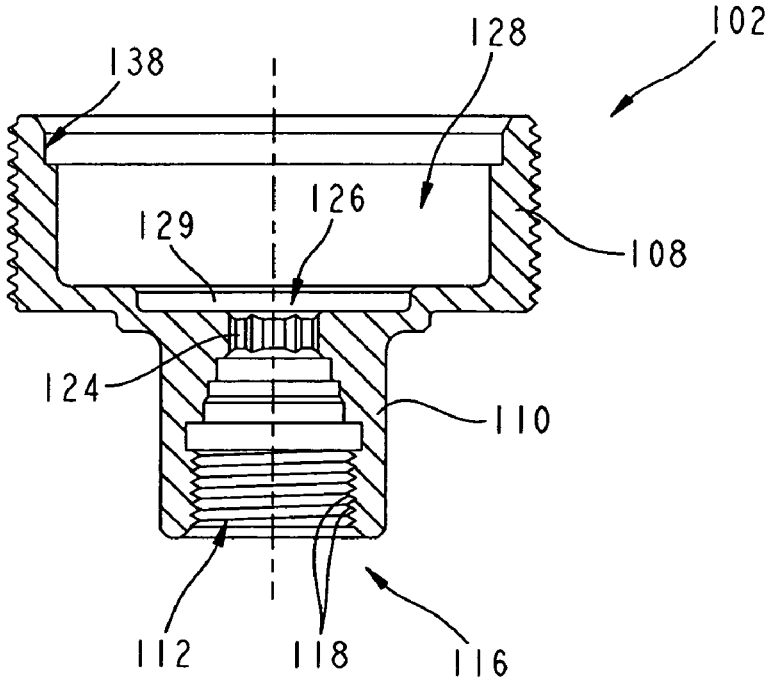
FIG. 13 is a cross-sectional view of the nipple taken along line 13-13 of FIG. 12.

The outer surface 38 of the lower portion 26 of pivot body 16 includes a downwardly facing semi-spherical portion 40, as shown in FIGS. 3, 7 and 11. The pivot body 16 defines a longitudinal body axis 42 and includes a passageway or opening 44 formed in the lower portion 26 and concentrically positioned about the longitudinal body axis 42. The opening 44 is illustratively defined by an integral tubular member 46 extending from above the inner surface 28 to below the outer surface 38 of the pivot body 16. The pivot body 16 may be formed from a thermoplastic material, although other suitable materials may be substituted therefor.

With reference to FIGS. 3, 7-9, and 11, the holder 18 includes a body 52 having a side wall 54 extending upwardly and outwardly from an opening 56. The opening 56 is concentrically disposed about a longitudinal holder axis 58, which in FIG. 3 is shown in a coaxially aligned position with the longitudinal axis 42 of the pivot body 16. An annular ring or lip 60 extends outwardly from an upper end of the sidewall 54. An annular seat 62 is defined within an inner surface of the side wall 54 and is configured to receive the annular seal 19, illustratively a conventional O-ring formed of a resilient material, such as an elastomer. While an annular seal 19 is illustrated, it should be appreciated that other seals may be substituted therefor.

A plurality of webs or ribs 66 extend inwardly from the inner surface 68 of the side wall 54 from above the seat 62. Each of the ribs 66 includes an arcuate inwardly facing surface 70 such that in combination, the ribs 66 define a semi-spherical surface substantially conforming to the shape of the semi-spherical outer surface 40 of the pivot body 16. The holder 18 may be formed from a thermoplastic material, although other suitable materials may be substituted therefor.

Figure 10:
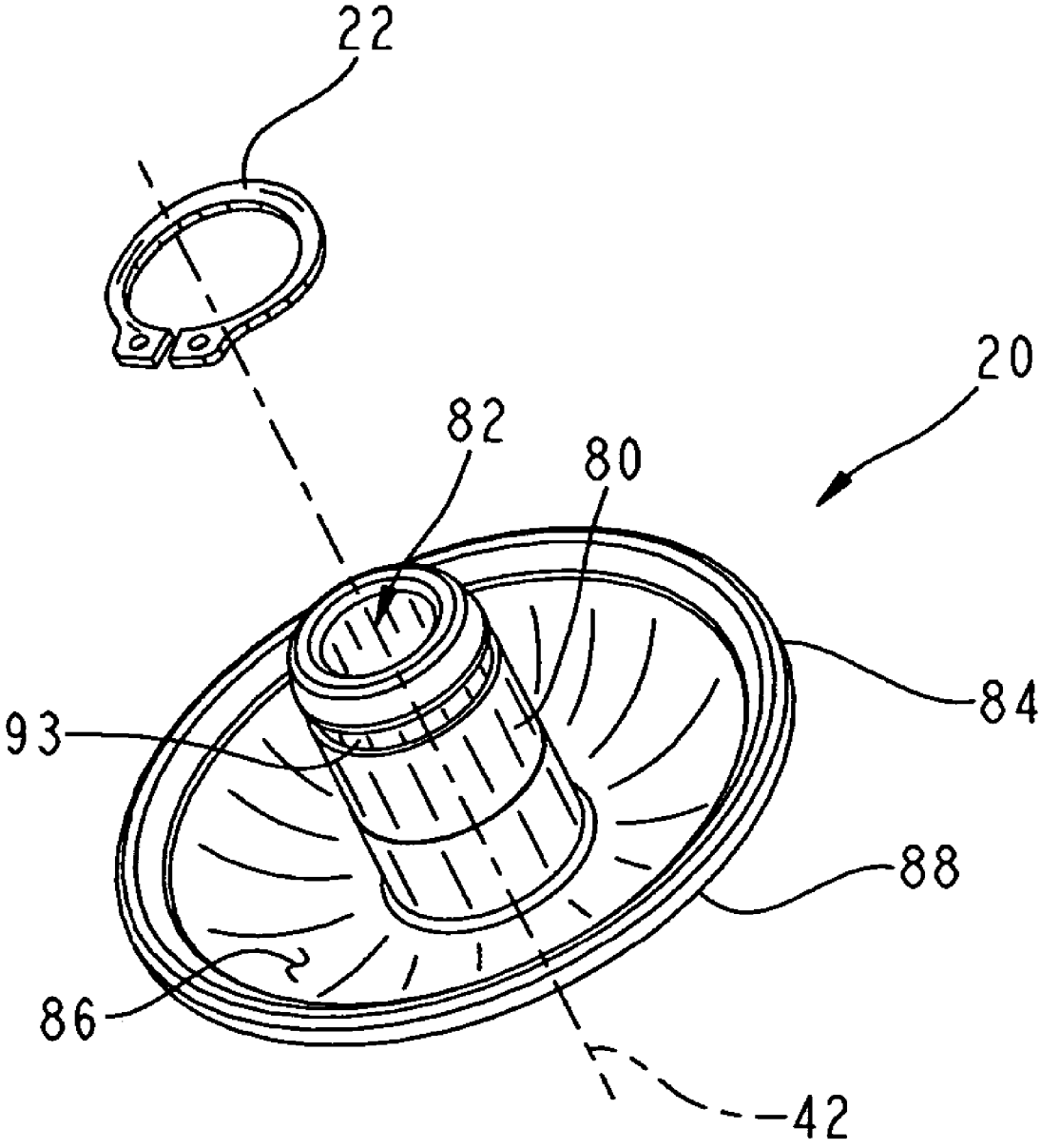
FIG. 10 is a detailed exploded perspective view of the first retainer and the second retainer of the swivel mount of the present invention.

Referring now to FIGS. 3, 10, and 11, the first or lower retainer 20 includes an axially extending tubular portion 80 defining a fluid passageway 82 which is cconcentrically disposed about the longitudinal body axis 42. A retaining member, illustratively an upwardly curved disc 84, extends outwardly from a lower end of the tubular portion 80. The disc 84 includes an upwardly facing semi-spherical or concave surface 86 and a downwardly extending semi-spherical or convex surface 88. The tubular portion 80 is concentrically received within the opening 44 of tubular member 46 of body 16. The first retainer 20 is illustratively formed of brass, although other suitable materials may be readily substituted therefor.

Figure 4:
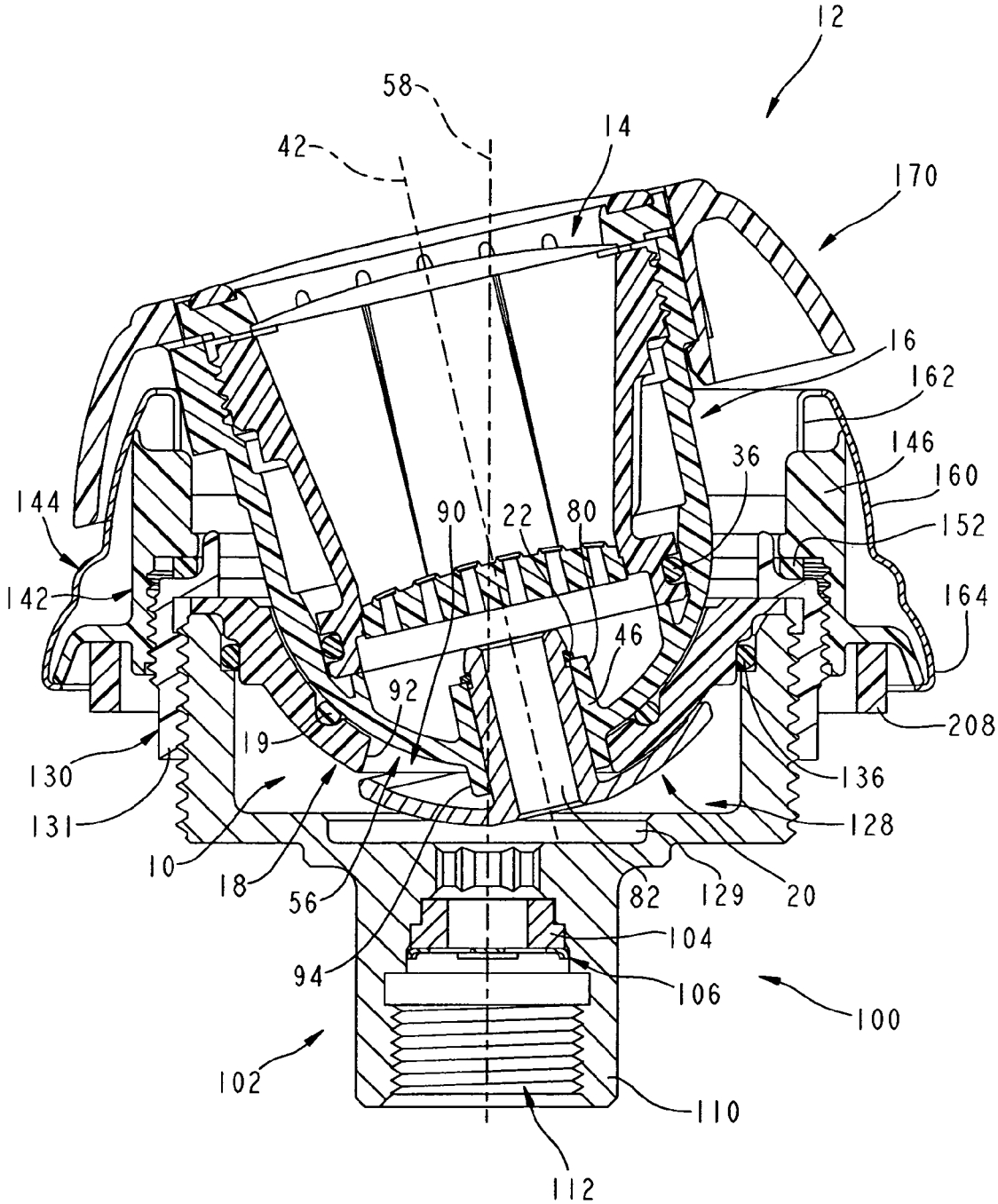
FIG. 4 is a cross-sectional view similar to FIG. 3, illustrating the spray head pivoted to the left relative to its position in FIG. 3 and with details of the fluid chips of the spray head removed for clarity.
Figure 5:
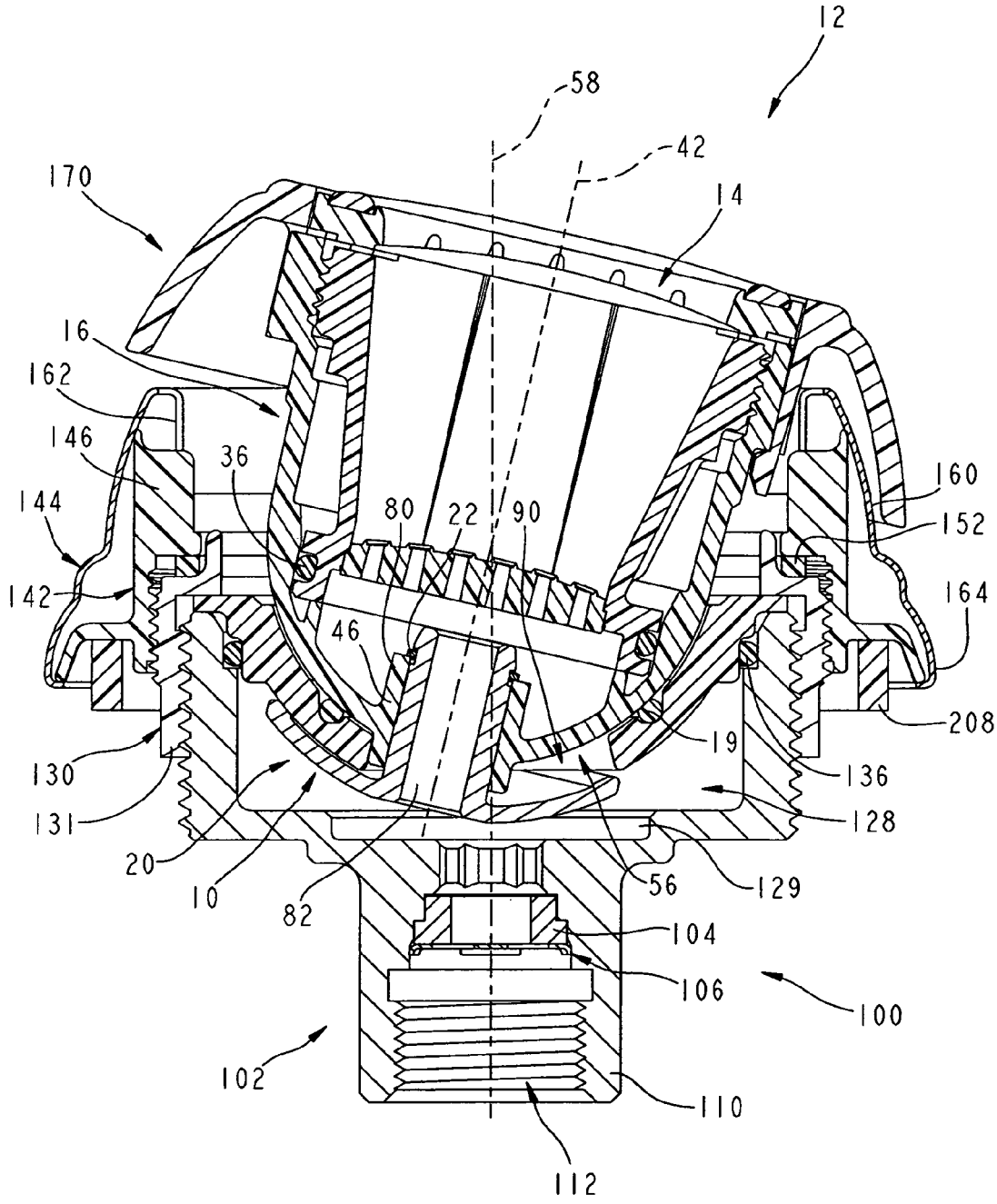
FIG. 5 is a view similar to FIG. 3, illustrating the spray head pivoted to the right relative to its position in FIG. 3 and with details of the fluid chips of the spray head removed for clarity.

A generally bowl-shaped passageway 90 is defined intermediate the semi-spherical portion 40 of outer surface 38 of pivot body 16 and the facing surface 86 of disc 84 of the first retainer 20. The side wall 54 of the holder 18 is received within the passageway 90. The pivot body 16 and the first retainer 20 are rotatable relative to the holder 18 about the longitudinal axis 42, and are pivotable relative to the holder 18 about axes orthogonal to the longitudinal axis 42. As such, the spray head 14 within the body 16 has three degrees of rotational freedom and may be oriented as desired by the user. As shown in FIGS. 4 and 5, the first retainer 20 and the pivot body 16 supporting the spray head 14 are supported for pivoting movement relative to the holder 18 such that the longitudinal body axis 42 may be angularly offset from the longitudinal holder axis 58.

The cylindrical surface 92 defining the opening 56 of the holder 18 defines a stop to limit pivoting movement of the pivot body 16. More particularly, engagement between the outer surface 94 of the tubular member 46 of pivot body 16 and the surface 92 of the holder 18 stops further pivoting movement in a given direction (FIGS. 4 and 5).

The second retainer 22 is coupled proximate an upper end of the tubular portion 80 of the first retainer 20. More particularly, the second retainer 22 illustratively comprises a conventional spring clip received within a groove 93 formed proximate the upper end of the tubular portion 80. It should be appreciated that other suitable retainers could be substituted for the spring clip. For example, the upper end of the tubular portion 80 could support a plurality of threads which engage a conventional nut or a plurality of threads integrally formed within the pivot body 16.

The first retainer 20 and the second retainer 22 axially clamp or squeeze the seal 19 between the pivot body 16 and the holder 18. The distance between the disc 84 of the first retainer 20 and the second retainer 22 is dimensioned so as to provide sufficient compressive force on the seal 19 for providing sealing engagement between the holder 18 and the pivot body 16 while still permitting rotating and pivoting movement of the body 16 relative to the holder 18. In other words, the first retainer 20 and the second retainer 22 cooperate to compress the seal 19 in order to provide a dynamic seal between the pivot body 16 and the holder 18.

As shown in FIGS. 2-6, the swivel mount assembly 10 is mounted within a nipple assembly 100 including a nipple 102, a flow regulator 104, and a retaining clip 106. With reference to FIGS. 2, 3, 12, and 13, the nipple 102 includes a cylindrical upper socket 108 and a cylindrical lower connector 110. A fluid passageway 112 extends through the connector 110 to the socket 108. The fluid passageway 112 is in fluid communication with the passageway 82 of the first retainer 20 through a fluid chamber 128. The flow regulator 104 is of conventional design and is received within the passageway 112.

The flow regulator 104 is retained in position by the retaining clip 106. As shown in FIGS. 2 and 3, the retaining clip 106 includes a plurality of wedge-shaped openings 113 in fluid communication with the flow regulator 104, and a plurality of outwardly extending retaining tabs 114. The retaining tabs 114 frictionally engage the inner surface 115 of the passageway 112 through an interference fit therewith.

The lower end 116 of the fluid passageway 112 includes a plurality of female threads 118 configured to threadably engage a plurality of male threads 120 extending from a conventional water pipe 122 (FIG. 6). A hexagonal broach or opening 124 is concentrically received proximate an upper end 126 of the passageway 112 and is accessible through the socket 108 by conventional tools to assist in installation and removal of the nipple 102 to conventional pipe 122. The fluid chamber 128 includes a relief area 129 which provides clearance for pivoting movement of the first retainer 20 (FIGS. 4 and 5). The nipple 102 is illustratively formed from brass, although other suitable materials may be substituted therefor.

With reference to FIGS. 2-6, a bonnet 130 concentrically receives and is coupled to the socket 108 of the nipple 102. The bonnet 130 illustratively includes a generally cylindrical body 131 having a plurality of inwardly facing or female threads 132 which threadably engage a plurality of outwardly facing or male threads 134 formed within the socket 108 of the nipple 102. The body 131 of the bonnet 130 includes a retaining ring 135 wherein the annular lip 60 of the holder 18 is coupled intermediate the retaining ring 135 of the bonnet 120 and the socket 108 of the nipple 102. The bonnet 130 is illustratively made of brass, although other suitable materials may be readily substituted therefor.

An annular seal 136 is illustratively supported intermediate an annular seat 138 formed within the socket 108 of the nipple 102 and a seat 139 formed within the side wall 54 of the holder 18. The annular seal 136 illustratively comprises a conventional O-ring formed of a resilient material, such as an elastomer.

Figure 14:
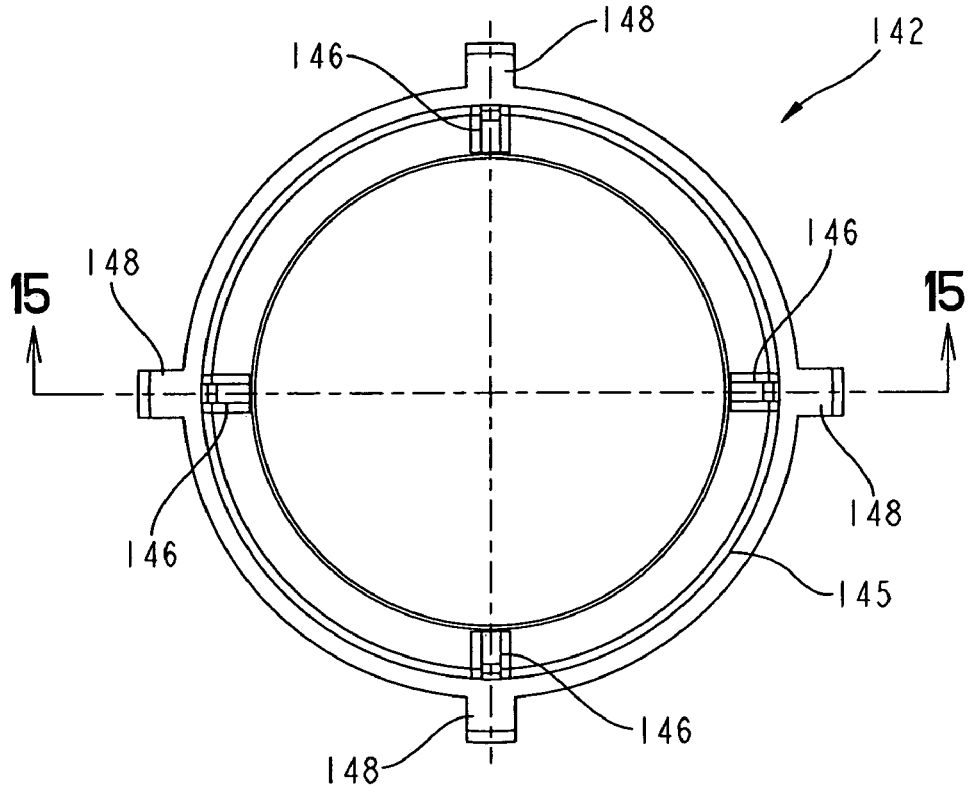
FIG. 14 is a top plan view of the sleeve.
Figure 15:
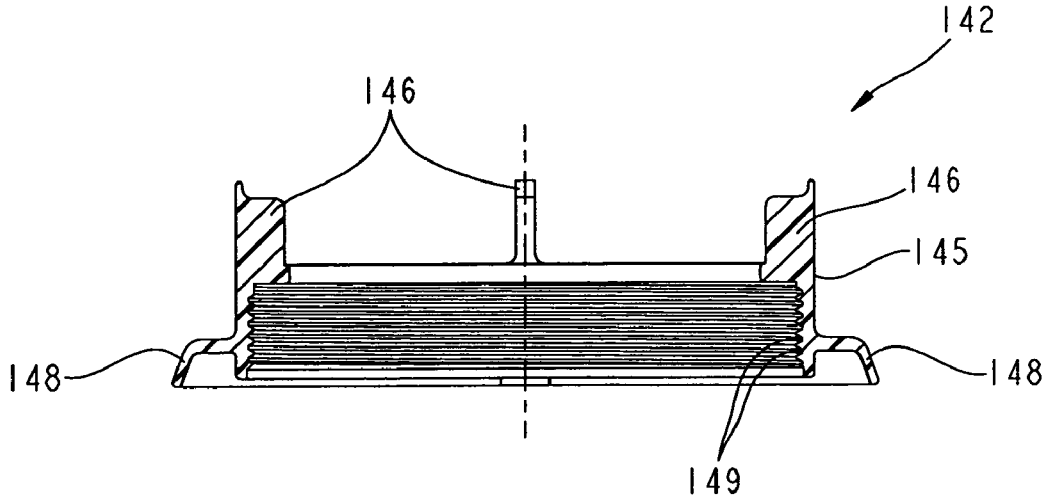
FIG. 15 is a cross-sectional view of the sleeve taken along line 15-15 of FIG. 14.

A shroud assembly 140 includes a sleeve 142 and a shroud 144. The sleeve 142 concentrically receives and is coupled to the bonnet 130. As shown in FIGS. 14 and 15, the sleeve 142 illustratively includes a generally cylindrical body 145, a plurality of supports 146 extending upwardly from the body 145, and a plurality of locking tabs 148 extending outwardly and downwardly from the body 145. A plurality of inwardly facing or female threads 149 threadably engage a plurality of outwardly facing or male threads 150 supported on the bonnet 130. The sleeve 142 may be formed from a thermoplastic or other suitable material.

An annular seal 152 is illustratively positioned intermediate the bonnet 130 and the sleeve 142. The seal 152 is illustratively formed of a resilient material, such as a polyethylene. The bonnet 130 includes an annular seat 154 and a plurality of locating tabs 156 extending upwardly adjacent to the seat, wherein the seal 152 is supported by the seat 154 and is positioned by the locating tabs 156.

The shroud 144 concentrically receives the sleeve 142 and includes an upper portion 160 supported by the plurality of supports 146 of the sleeve 142. A plurality of downwardly extending tabs 162 are circumferentially positioned intermediate the supports 146 of the sleeve 142 and restrain rotational movement of the shroud 144. The shroud 144 further includes a lower portion 164 including an annular lip 166 operably coupled to the plurality of locking tabs 148 of the sleeve 142. The cooperation between the upper portion 160 and the supports 146, along with the cooperation between the lower portion 164 and the locking tabs 148 permits for a convenient and simple snap-fit installation of the shroud 144 to the sleeve 142. The shroud 144 is illustratively formed from brass, although other suitable materials may be substituted therefor.

Figure 16:
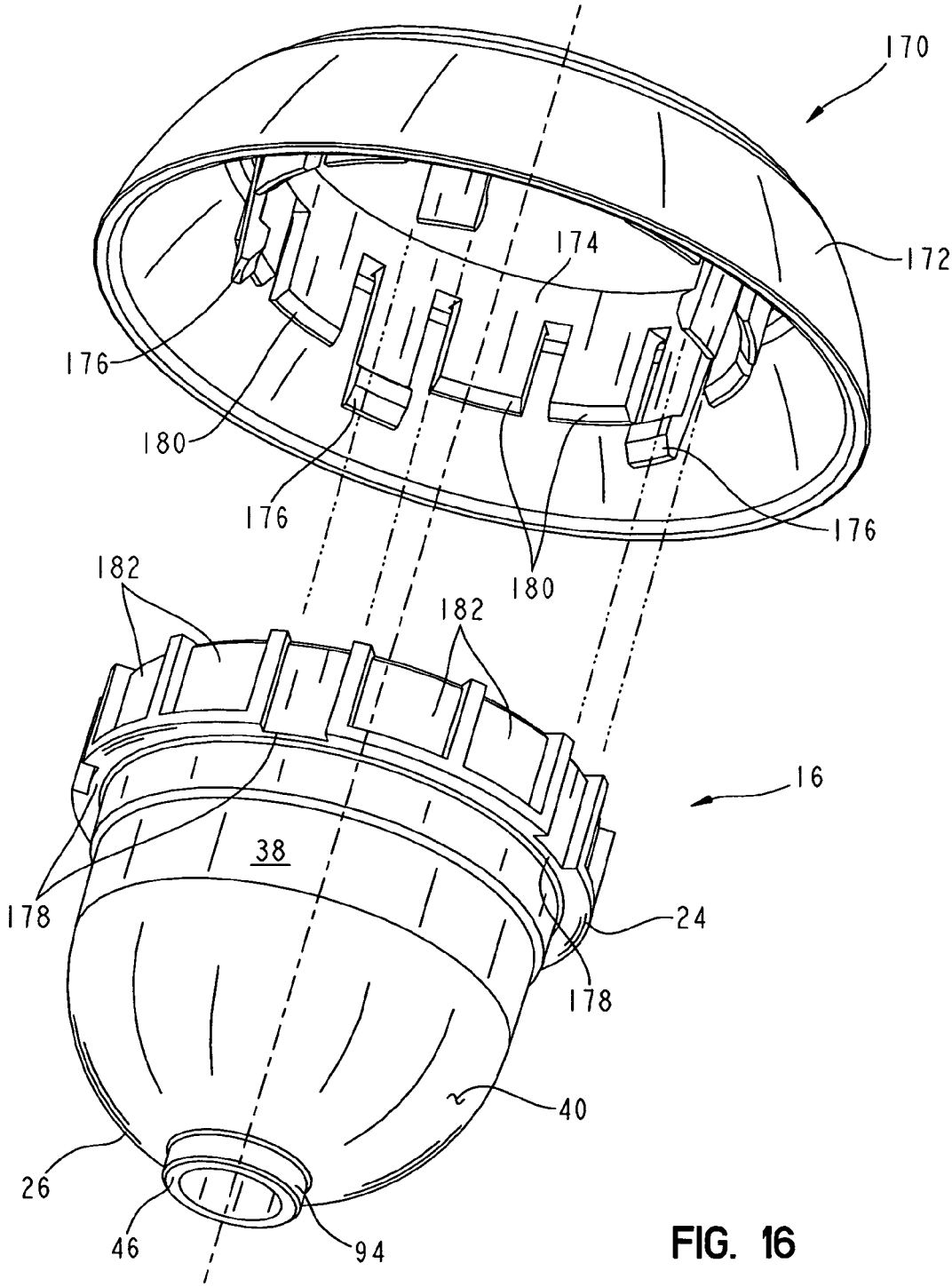
FIG. 16 is a detailed exploded perspective view of the body and the cover of the present invention.

With reference to FIGS. 2, 3, and 16, a cover 170 concentrically receives the upper portion 160 of the shroud 144 and is coupled to the upper portion 24 of the pivot body 16. More particularly, the cover 170 includes an outer shield portion 172 concentrically receiving the upper portion 160 of the shroud 144. The cover 170 further includes an inner support portion 174 having a plurality of locking tabs 176 positioned inwardly from the outer shield portion 172. The plurality of locking tabs 176 are operably coupled with a plurality of lips 178 formed within the outer surface of the body 16 and are configured to cooperate therewith to axially secure the cover 170 to the body 16. The inner support portion 174 of the cover 170 further includes a plurality of locating tabs 180 positioned inwardly from the outer shield portion 172 and circumferentially offset from the locking tabs 176. The outer surface of the pivot body 16 includes a plurality of circumferentially spaced channels 182 configured to receive the locating tabs 180. Cooperation between the locating tabs 180 and the channels 182 assists in proper angular orientation between the cover 170 and the pivot body 16 while also rotatably securing the cover 170 to the pivot body 16. The cover 170 may be formed from a thermoplastic or other suitable material.

Referring now to FIGS. 3 and 17, in the illustrative embodiment of the present invention, the spray head 14 includes a fluidic cartridge assembly 190 including a plurality of fluid chips 192 disposed within a channel 194 of a holder body 196. A base or diverter 198 is positioned below the fluid chips 192 and is in fluid communication with the passageway 82 of the first retainer 20. A top plate 200 is secured to the body 196 and is configured to secure the fluid chips 192 therewithin. A plurality of conventional fasteners, such as screws 202, may be utilized to secure the top plate 200 to the body 196. The annular seal 36, illustratively a conventional O-ring formed of a resilient material, is supported by a seat 204 formed within an outer surface of the body 196. As shown in FIGS. 2 and 3, a label 206 may be secured to an upper surface of the top plate 200 to provide an aesthetically pleasing appearance to the finished body spray assembly 12.

The fluid chips 192 of the fluidic cartridge assembly 190 are designed to provide a desired fluid flow pattern. While the illustrative embodiment uses such fluid chip technology, as noted above, it should be appreciated that other types of spray heads may be readily substituted therefor.

With reference to FIGS. 2 and 6, an annular mounting seal 208 is illustratively positioned intermediate the sleeve 142 and the mounting surface 210 of the wall 11. The mounting seal 208 illustratively comprises a polyethylene material, but other suitable materials may be readily substituted therefor.

With further reference to FIGS. 2 and 3, assembly of the spray head assembly 12 begins with the formation of the swivel mount assembly 10. The swivel mount assembly 10 is assembled by initially placing the annular seal 19 into the seat 62 of the holder 18. Next, the pivot body 16 is inserted into the holder 18 such that the semi-spherical outer surface 40 of the pivot body 16 is facing the surfaces 70 of the ribs 66 of the holder 18. The body 16 and the holder 18 are retained in place by the fastener formed by the first retainer 20 and the second retainer 22. More particularly, the tubular portion 80 of the first retainer 20 is inserted through the openings 56 and 44 of the holder 18 and the pivot body 16, respectively. Next, the second retainer 22, illustratively a spring clip, is coupled to the upper end of the tubular portion 80 of the first retainer 20. As noted above, the first and second retainers 20 and 22 compress the seal 19 between the body 16 and the holder 18. At this point in the process, assembly of the swivel mount 10 is complete.

The spray head 14, in the illustrative form of fluidic cartridge assembly 190, is assembled by inserting the fluid chips 192 and the diverter 198 within the channel 194 of the body 196. The top plate 200 is secured to the body 196 by screws 202 and covered by the label 206 which is adhesively affixed thereto. The annular seal 36 is then placed within seat 204. Next, the spray head 14 is inserted into the body 16 thereby forming a first installation assembly.

The nipple assembly 100 defines a second installation assembly and is assembled by inserting the flow regulator 104 into the passageway of the nipple 102. Next, the retaining clip 106 is inserted within the passageway and forms an interference fit therein. The flow regulator 104 is thereby retained in place.

The shroud assembly 140 defines a third installation assembly and is assembled by placing the shroud 144 over the sleeve 142. More particularly, the upper portion 160 intermediate the tabs 162 is supported by supports 146 of the sleeve 142, and the annular lip 166 of the shroud 144 couples to the locking tabs 148 of the sleeve 142. As such, the shroud 144 is easily "snap-fit" over the sleeve 142.

During installation, the installer couples the nipple assembly 100 to the external pipe 122 by threading the female threads 118 of the nipple 102 onto the male threads 120 of the pipe 122. As needed, the installer may insert a tool, such as a wrench, into the hexagonal opening 124 of the nipple 102. Next, the first installation assembly, including the swivel mount assembly 10 and the spray head 14, is inserted into nipple assembly 100, or second installation assembly. More particularly, the seal 136 is placed in the seat 138 of the nipple socket 108, and the swivel mount assembly 10 is inserted into the nipple socket 108. The bonnet 130 is then coupled to the nipple 102 by threading the female threads 132 of the bonnet 130 onto the male threads 134 of the nipple 102, thereby securing the lip 60 of the holder 18 between the nipple 102 and the bonnet 130.

Next, the seal 208 is placed against the mounting surface 240 of the wall 11, and the seal 152 is compressed between the sleeve 142 and the bonnet 130, by coupling the shroud assembly 140 or third installation assembly, to the bonnet 130. More particularly, the seal 152 is placed on the seat 154 of the bonnet 130 and positioned by the tabs 156. Next, seal 208 is placed over the nipple 102. The female threads 149 of the sleeve 142 are then threaded onto the male threads 150 of the bonnet 130, thereby compressing the seals 152 and 208.

Finally, the cover 170 is coupled to the pivot body 16 by aligning the locating tabs 180 within the channels 182 and aligning the locking tabs 176 with the lips 178. As detailed above, the locking tabs 176 couple with the lips 178 to secure the body 16 with the cover 170.

Although the invention has been described in detail with reference to certain preferred embodiments, variations and modifications exist within the spirit and scope of the invention as described and defined in the following claims.

The invention claimed is:

1. A swivel mount for a spray head comprising:

a holder including an opening concentrically disposed about a longitudinal holder axis;

a first retainer including an axially extending tubular portion and a retaining member extending outwardly from the tubular portion, the tubular portion being received within the opening of the holder;

a body including an outer surface having a semi-spherical portion and an opening concentrically receiving the tubular portion of the first retainer, the body defining a longitudinal body axis;

a seal positioned in sealing engagement with the semi-spherical portion of the body and the holder; and wherein the body is supported for pivoting movement relative to the holder such that the longitudinal body axis may be angularly offset from the longitudinal holder axis.

2. The swivel mount of claim 1, further comprising a second retainer supported by the tubular portion of the first retainer, wherein axial movement of the body relative to the holder is restrained by the first retainer and the second retainer.

3. The swivel mount of claim 1, further comprising a nipple including a socket concentrically receiving the holder and a passageway in fluid communication with the tubular portion of the first retainer.

4. The swivel mount of claim 3, further comprising an annular seal positioned intermediate the nipple and the holder, wherein the nipple includes an annular seat configured to support the annular seal.

5. The swivel mount of claim 3, further comprising a bonnet concentrically receiving and coupled to the socket of the nipple, the bonnet including a retaining ring and the holder including an annular lip, wherein the annular lip of the holder is coupled intermediate the socket of the nipple and the retaining ring of the bonnet.

6. The swivel mount of claim 5, further comprising: a sleeve concentrically receiving and coupled to the bonnet, the sleeve including a generally cylindrical body, a plurality of supports extending upwardly from the body, and a plurality of locking tabs extending outwardly from the body; and a shroud including an upper portion supported by the plurality of supports of the sleeve and a lower portion including an annular lip operably coupled to the plurality of locking tabs of the sleeve.

7. The swivel mount of claim 6, further comprising an annular seal positioned intermediate the bonnet and the sleeve, wherein the bonnet includes an annular seat and a plurality of locating tabs extending upwardly adjacent to the seat, the annular seal being supported by the seat and positioned by the locating tabs.

8. The swivel mount of claim 6, further comprising a cover including an outer shield portion concentrically receiving the shroud and an inner support portion coupled to the body for movement relative to the shroud.

9. The swivel mount of claim 8, wherein the outer surface of the body includes a plurality of circumferentially spaced lips and the inner support portion of the cover includes a plurality of locking tabs positioned inwardly from the outer shield portion, the plurality of locking tabs being operably coupled with the plurality of lips of the body to axially secure the cover to the body.

10. The swivel mount of claim 9, wherein the outer surface of the body includes a plurality of circumferentially spaced channels and the inner support portion of the cover includes a plurality of locating tabs positioned inwardly from the outer shield portion and disposed intermediate the locking tabs, the locating tabs being operably coupled with the channels of the body to rotatably secure the cover to the body.

11. The swivel mount of claim 3, further comprising a flow regulator received within the passageway of the nipple and a retainer operably coupled with the nipple to retain the flow regulator within the nipple.

12. The swivel mount of claim 3, further comprising a hexagonal opening concentrically received within the passageway of the nipple and configured to receive a tool.

13. A fluid delivery assembly configured to be at least partially recessed within a mounting surface of a wall, the fluid delivery assembly comprising:

a fluid spray head;

a body receiving and coupled to the fluid spray head, the body including a downwardly facing semi-spherical surface and an opening concentrically disposed about a longitudinal axis;

a lower retainer including a disc having an upwardly facing semi-spherical surface positioned in spaced relation to the downwardly facing semi-spherical surface of the body;

a generally bowl-shaped passageway defined intermediate the semi-spherical surface of the body and the semi-spherical surface of the lower retainer; and a holder received within the passageway, the body and the lower retainer being pivotable relative to the holder about axes orthogonal to the longitudinal axis, thereby orienting the fluid spray head in a desired position.

14. The fluid delivery assembly of claim 13, wherein the body is rotatable about the longitudinal axis.

15. The fluid delivery assembly of claim 13, further comprising an annular seal received intermediate the body and the holder.

16. The fluid delivery assembly of claim 13, wherein the lower retainer includes an axially extending tubular portion extending upwardly from the disc and received within the opening of the body.

17. The fluid delivery assembly of claim 13, further comprising an upper retainer coupled to the lower retainer such that the body and the holder are positioned axially intermediate the lower retainer and the upper retainer.

18. The fluid delivery assembly of claim 13, further comprising a nipple including a socket concentrically receiving the holder and a passageway in fluid communication with the fluid spray head through the opening of the body.

19. The fluid delivery assembly of claim 18, further comprising a bonnet concentrically receiving and coupled to the socket of the nipple, the bonnet including a retaining ring and the holder including an annular lip, wherein the annular lip of the holder is secured intermediate the socket of the nipple and the retaining ring of the bonnet.

20. The fluid delivery assembly of claim 19, further comprising: a sleeve coupled to the bonnet and including an annular body supporting a downwardly facing seat; and an annular seal positioned axially intermediate the seat and a mounting surface of a wall such that at least a portion of the body is recessed within the wall.

21. The fluid delivery assembly of claim 19, further comprising: a sleeve concentrically receiving and coupled to the bonnet, the sleeve including an annular body, a plurality of supports extending upwardly from the body, and a plurality of locking tabs extending outwardly from the body; and a shroud including an upper portion supported by the plurality of supports of the sleeve and a lower portion including an annular lip operably coupled to the plurality of locking tabs of the sleeve.

22. The fluid delivery assembly of claim 21, further comprising a cover including an outer shield portion concentrically receiving the shroud and an inner support portion coupled to the body for movement relative to the shroud.

23. A body spray assembly including:

a holder including an upper semi-spherical surface, a lower semi-spherical surface, and an opening concentrically disposed about a longitudinal holder axis;

a first retainer including an axially extending tubular portion and a disc extending outwardly from the tubular portion, the tubular portion being received within the opening of the holder and the disc including an upper semi-spherical surface conforming to the shape of the lower semi-spherical surface of the holder;

a body including a downwardly facing semi-spherical surface conforming to the shape of the upper semi-spherical surface of the holder and an opening concentrically receiving the tubular portion of the first retainer, the body defining a longitudinal body axis;

a fluid spray head received within and coupled to the body;

an annular seal in sealing engagement with the holder and the body;

a second retainer coupled to the tubular portion of the first retainer;

the holder and the body being positioned axially intermediate the disc of the first retainer and the second retainer, and the first retainer and the body are pivotable about the holder such that the longitudinal body axis may be angularly offset from the longitudinal holder axis;

a nipple including a socket concentrically receiving the holder and a passageway in fluid communication with the tubular portion of the first retainer;

an annular seal positioned intermediate the nipple and the holder, wherein the nipple includes an annular seat to support the seal;

a bonnet concentrically receiving and coupled to the socket of the nipple, the bonnet including a retaining ring and the holder including an annular lip, the annular lip of the holder being coupled intermediate the socket of the nipple and the retaining ring of the bonnet;

a sleeve concentrically receiving and coupled to the bonnet, the sleeve including a generally cylindrical body, a plurality of supports extending upwardly from the body, and a plurality of locking tabs extending outwardly from the body;

a shroud including an upper portion supported by the plurality of supports of the sleeve and a lower portion including an annular lip operably coupled to the plurality of locking tabs of the sleeve;

an annular seal positioned intermediate the bonnet and the sleeve, wherein the bonnet includes an annular seat and a plurality of locating tabs extending upwardly adjacent to the seat, the seal being supported by the seat and positioned by the locating tabs; and a cover including an outer shield portion concentrically receiving the shroud and an inner support portion coupled to the body for movement relative to the shroud.

24. A swivel mount for a spray head comprising:

a holder including an opening concentrically disposed about a longitudinal holder axis;

a first retainer including an axially extending tubular portion and a retaining member extending outwardly from the tubular portion, the tubular portion being received within the opening of the holder;

a body including an outer surface having a semi-spherical portion and an opening concentrically receiving the tubular portion of the first retainer, the body defining a longitudinal body axis;

a seal positioned in sealing engagement with the semi-spherical portion of the body;

a second retainer supported by the tubular portion of the first retainer; and wherein the body is supported for pivoting movement relative to the holder such that the longitudinal body axis may be angularly offset from the longitudinal holder axis, and axial movement of the body relative to the holder is restrained by the first retainer and the second retainer.

* * * * *